US008087277B2

(12) United States Patent
Umeda et al.

(10) Patent No.: US 8,087,277 B2
(45) Date of Patent: Jan. 3, 2012

(54) METHOD FOR CORRECTING METAL TUBE AND CORRECTIVE PRESS DIE

(75) Inventors: Takeshi Umeda, Toyota (JP); Yoshiaki Kadoma, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 465 days.

(21) Appl. No.: 11/991,259

(22) PCT Filed: Oct. 16, 2006

(86) PCT No.: PCT/JP2006/320990

§ 371 (c)(1),
(2), (4) Date: Feb. 29, 2008

(87) PCT Pub. No.: WO2007/049526

PCT Pub. Date: May 3, 2007

(65) Prior Publication Data

US 2009/0049884 A1 Feb. 26, 2009

(30) Foreign Application Priority Data

Oct. 28, 2005 (JP) ..... 2005-314919

(51) Int. Cl.
*B21C 51/00* (2006.01)

(52) U.S. Cl. ..... 72/31.06; 72/360; 72/367.1; 72/370.24; 72/414

(58) Field of Classification Search ..... 72/31.06, 72/367.1, 368, 369, 370.23, 370.24, 31.03, 72/360, 370.25, 414, 415, 475, 31.02, 370.04, 72/370.13

See application file for complete search history.

(56) References Cited

U.S. PATENT DOCUMENTS

| | | | | | |
|---|---|---|---|---|---|
| 1,319,837 | A | * | 10/1919 | Brinkman | 72/370.25 |
| 1,778,438 | A | * | 10/1930 | Vincent | 72/396 |
| 1,872,384 | A | * | 8/1932 | Andren | 72/369 |
| 2,316,839 | A | * | 4/1943 | Claybaugh | 72/368 |
| 2,500,813 | A | * | 3/1950 | Fritsch | 29/890.149 |
| 2,515,841 | A | * | 7/1950 | Stuart | 72/360 |
| 2,778,101 | A | * | 1/1957 | Dullum | 72/356 |
| 2,780,000 | A | * | 2/1957 | Huet | 72/342.6 |

(Continued)

FOREIGN PATENT DOCUMENTS

| | | | |
|---|---|---|---|
| JP | 57-32831 | * | 2/1982 |
| JP | 64-040121 | A | 2/1989 |
| JP | 4-79727 | B2 | 12/1992 |

(Continued)

*Primary Examiner* — Edward Tolan
(74) *Attorney, Agent, or Firm* — Kenyon & Kenyon LLP

(57) ABSTRACT

The forming recesses of a lower die and an upper die are formed to have a semi-oval profile so as to provide a forming space almost oval in section with the dies closed. The parting line between the lower die and the upper die is deviated as much as h from the major axis of the forming space toward the upper die side, and the opening width of the forming recess of the lower die is set to be slightly larger than the opening width of the forming recess of the upper die. A metal bent tube is plastic-deformed into an almost oval shape in section by closing the dies while being compressed in a peripheral direction by the lower and upper dies to eliminate spring-back caused by bending, whereby the buckling and pinching toward the outer side of the tube wall is prevented by the expanded portion of the lower die and buckling toward the inner side of the tube wall is prevented by a step difference formed by the difference in opening width between the lower die and the upper die.

5 Claims, 4 Drawing Sheets

U.S. PATENT DOCUMENTS

| | | | | | |
|---|---|---|---|---|---|
| 2,841,865 | A | * | 7/1958 | James | 72/58 |
| 2,889,866 | A | * | 6/1959 | Braun | 72/331 |
| 3,514,843 | A | * | 6/1970 | Cernik | 29/559 |
| 3,869,776 | A | * | 3/1975 | Moshnin et al. | 29/890.149 |
| 4,339,941 | A | * | 7/1982 | Taira et al. | 72/412 |
| 4,513,601 | A | * | 4/1985 | Herbulot | 72/398 |
| 4,930,331 | A | * | 6/1990 | Manning | 72/396 |

FOREIGN PATENT DOCUMENTS

| | | |
|---|---|---|
| JP | 08-206737 | 8/1996 |
| JP | 2003-182385 A | 7/2003 |
| JP | 3593381 | 9/2004 |
| JP | 3642244 | 2/2005 |
| JP | 2005-081393 A | 3/2005 |

* cited by examiner

METHOD FOR CORRECTING METAL TUBE AND CORRECTIVE PRESS DIE

This is a 371 national phase application of PCT/JP2006/320990 filed 16 Oct. 2006, claiming priority to Japanese Patent Application No. 2005-314919 filed 28 Oct. 2005, the contents of which are incorporated herein by reference.

FIELD OF THE INVENTION

The present invention relates to a method for correcting a metal tube. More specifically, the present invention relates to a correction method suitable for correcting a bent metal tube and to a corrective press die for use in the correction method.

BACKGROUND OF THE INVENTION

When a metal tube is bent, it becomes difficult to secure a desired shape precision due to spring-back after bending. Therefore, bending has generally been carried out factoring in an amount of spring-back. However, the amount of spring-back varies depending on the material, the size of the tube, the bending angle, the number of bendings, and the like. When the number of bendings is large, it is especially difficult to accurately estimate the amount of spring-back. Thus, such a method is insufficient as a countermeasure for spring-back.

Patent Document 1 discloses a countermeasure in which a metal tube with spring-back due to bending is corrected by pressing and forming a number of annular grooves (concave grooves) on an outer peripheral surface of the metal tube at predetermined pitches. According to the countermeasure, since the metal tube is uniformly deformed by plastic deformation, the spring-back is eliminated and a desired shape precision can be secured.

According to the countermeasure for spring-back described in Patent Document 1, forming the annular grooves increases the section stiffness. However, as a number of annular grooves are provided on the metal tube in the lengthwise direction, there is a problem in which overall bending stiffness decreases. In addition, forming recesses of the press die have a semi-circular profile that reflects the cross-sectional shape of the metal tube. Therefore, it is difficult to stably set the metal tube that is deformed due to the spring-back, and thus, a forming defect is likely to occur.

Moreover, there is another problem in which forming annular grooves causes retraction of material at the tube ends, thereby significantly deteriorating end-face precision.

Patent Document 1: Japanese Patent Application Publication No. JP-A-2005-81393

SUMMARY OF THE INVENTION

Problems to be Solved by the Invention

The present invention was devised in light of problems with the related art described above. It is an object of the present invention to provide a correction method capable of correcting deformation of a metal tube without deteriorating overall bending stiffness and without causing a forming defect and an end-face-precision defect due to a setting failure, and to provide a corrective press die suitable for use in the correction method. In addition to the first object, it is a second object of the present invention to provide a correction method capable of securing end-face precision at a tube end and a corrective press die.

Means for Solving the Problem

In order to achieve the object described above, a method for correcting a metal tube according to the present invention is characterized by including: preparing a press die that forms a forming space having a substantially oval cross-section, which is wide in a die width direction when the die is closed; and closing the die while compressing a metal tube and restraining the tube end thereof using the press die so as to plastically deform the metal tube such that the metal tube has a substantially oval cross-section.

In such a method for correcting a metal tube, the metal tube is plastically deformed to have a substantially oval cross-section by compression in the circumferential direction. By this, the metal tube is distorted by the plastic deformation in a substantially uniform manner so that warping can be eliminated. In addition, since the metal tube after correction is a smooth shape having a substantially oval cross-section, the overall bending stiffness is sufficient. Moreover, the press die forms the forming space having a substantially oval cross-section, which is wide in a die width direction when the die is closed. Therefore, even if the metal tube deforms, the metal tube can be set in the forming recesses with margins.

Since the metal tube is plastically deformed so as to have a substantially oval cross-section while the tube end thereof is restrained, even if the metal tube tends to extend due to compression in the circumferential direction, such extension of the metal tube is controlled because the tube end thereof is restrained. As a result, a preferable end-face precision can be obtained.

According to the above method invention, the metal tube subjected to the correction may be a bent tube or a straight tube. When the straight tube is subjected to the correction, deformation accompanying spring-back is corrected. Thus, the method is extremely useful as a countermeasure against spring-back.

In order to achieve the object described above, a corrective press die of a metal tube of the present invention may be used in the method invention of the above. The press die is characterized in that forming recesses of the lower die and the upper die have a substantially semi-oval cross-section and form the forming space having a substantially oval cross-section that is wide in a die width direction when the dies are closed. On both sides of the forming recesses, walls are arranged so as to restrain the tube end of the metal tube. In the press die configured as described above, the forming recesses of the lower and upper dies have a substantially semi-oval cross-sectional profile. Therefore, the first aspect of the method described above can be carried out in a stable manner.

According to the press die, a parting line between the lower die and the upper die may be deviated from a position of a major axis of the forming space having a substantially oval cross-section toward an upper die side or a lower die side by a predetermined height, and also an inner wall of a portion formed by deviating the parting line may have a straight shape, an outward tapered shape, or a curved shape with a large curvature. By deviating the parting line, a portion of the bent metal tube, which first contacts a wall surface of the forming recess during die closure, is located lower than the parting line by a predetermined height. Thus, outward buckling or pinching of the tube wall is reliably prevented. Also, the portion formed by deviating the parting line does not form a negative angle in a press direction, resulting in a smooth mold release after correction.

When the parting line is deviated as described above, it is preferable that an opening width of a forming recess of the lower die or the upper die toward which the parting line is deviated is set larger than an opening width of a counterpart die thereof. By this, inward buckling of the tube wall is reliably prevented.

Effects of the Invention

According to the present invention (method invention and the device invention), spring-back can be eliminated without deteriorating the overall bending stiffness and causing a forming defect due to a setting failure. Therefore, the present invention is of high utility value.

Since the end-face precision at the tube end can be secured, the utility value of the present invention is further increased.

DESCRIPTION OF THE REFERENCE NUMERALS

1 FORMING RECESS OF LOWER DIE
2 LOWER DIE
2*a* EXTENSION OF LOWER DIE
3 FORMING RECESS OF UPPER DIE
4 UPPER DIE
5, 6 WALL (WALL BODY)
L PARTING LINE
S FORMING SPACE HAVING SUBSTANTIALLY OVAL CROSS-SECTION

DETAILED DESCRIPTION

Hereinafter, a best mode for carrying out the present invention will be described, with reference to the attached drawings.

Figure 1:
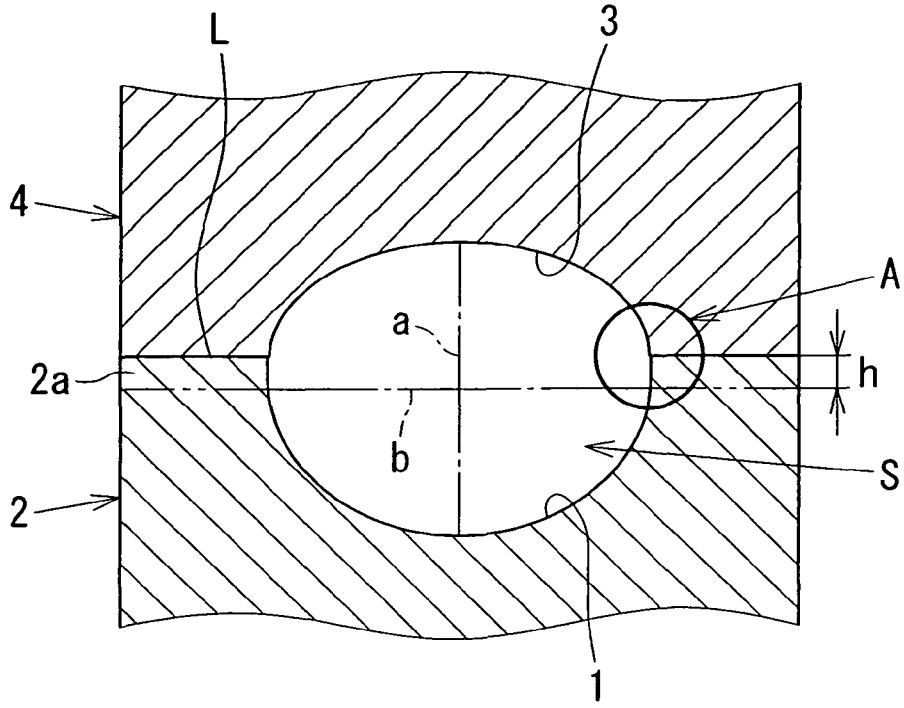
FIG. 1 is a cross-sectional view showing a structure of an essential part of a press die for correcting a metal tube according to the present invention.
Figure 2:
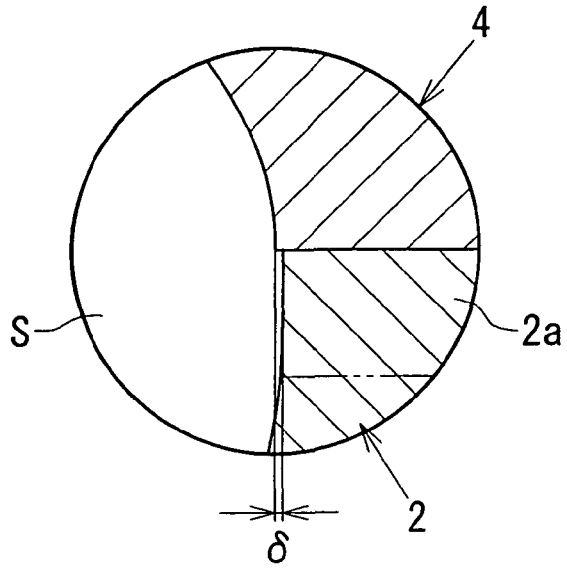
FIG. 2 is an enlarged cross-sectional view showing portion A of FIG. 1.
Figure 3:
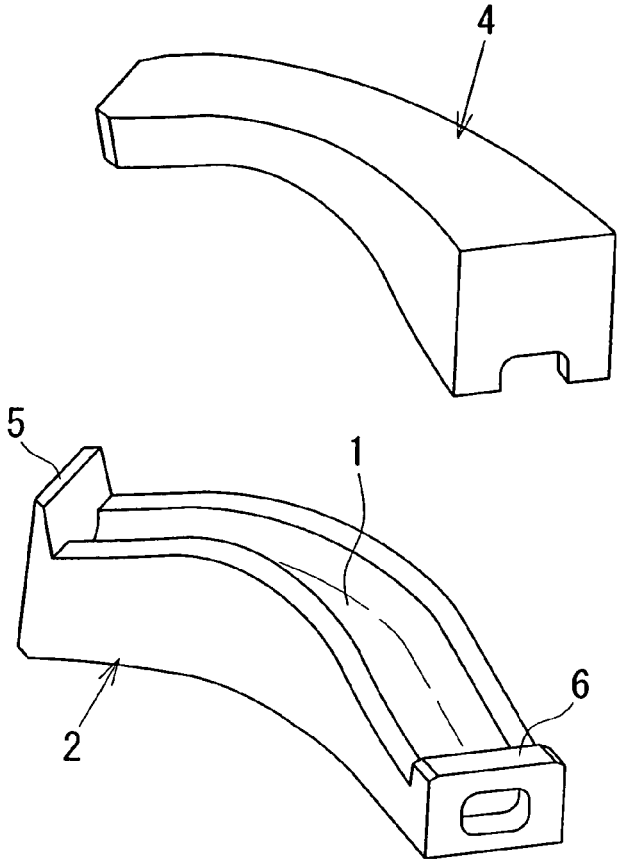
FIG. 3 is a perspective view showing a structure of the press die.
Figure 4:
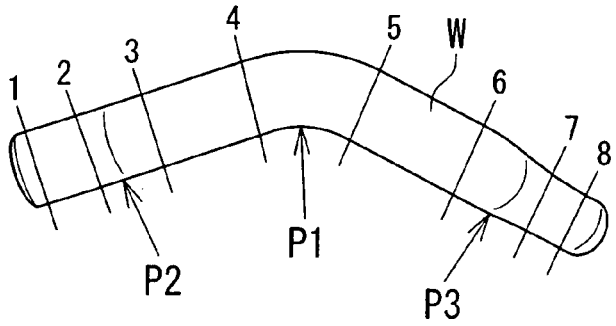
FIG. 4 is a plan view showing an example of the shape of the metal tube that is subjected to the correction according to the present invention.

FIGS. 1 to 3 show a corrective press die according to an embodiment of the present invention. This embodiment is intended to correct a metal tube that has been bent (hereinafter referred to as a "bent metal tube"). As shown in a plan view of FIG. 4, a bent metal tube W includes a larger bent portion P1 at an intermediate part in a lengthwise direction thereof, and also includes, at both ends thereof, bent portions P2, P3 bending backward in the drawing. That is, the bent metal tube W is a multi-bent tube with three bent portions. Note that the reference numerals in FIG. 4 are necessary in an example described later, and explanations thereof are omitted here.

The corrective press die includes a lower die 2 having a forming recess 1 at an upper surface thereof, and an upper die 4 having a forming recess 3 at a lower surface thereof. The upper die 4 is supported by a press upper ram (not shown), and is opened and closed with respect to the lower die 2 by the movement of the press upper ram. When the dies are closed, the forming recesses 1 and 3 are joined to form a forming space S between the lower die 2 and the upper die 4. In the present embodiment, the lower die 2 is provided, at both ends thereof, with walls (wall bodies) 5, 6 that close both ends of the forming recess 1. The respective heights of the walls 5, 6 are set such that the walls 5, 6 protrude higher than the upper surface of the lower die 2. The upper die 4 is closed with respect to the lower die 2, with both ends thereof in abutment with inner wall surfaces of the walls 5, 6. Note that the walls 5, 6 may be configured using blocks separate from the lower die 2, or using movable blocks.

As clearly shown in FIG. 1, the forming space S formed between the lower die 2 and the upper die 4 has a substantially oval cross-section that is wide in a width direction of the dies. The forming recess 1 of the lower die 2 and the forming recess 3 of the upper die 4 are formed so as to have respective semi-oval cross-sectional profiles. The profiles are formed by dividing the forming space S having a substantially oval cross-section into halves in a minor axis a direction. In the present embodiment, a parting line L between the lower die 2 and the upper die 4 deviates from a major axis b of the forming space S having a substantially oval cross-section between the lower and upper dies 2 and 4, by a predetermined height h toward the upper die 4 side. An extension 2*a* of the lower die 2 created by deviating the parting line L has an inner wall surface rising to form a curved shape having a large curvature (R). Meanwhile, an opening width of the forming recess 1 of the lower die 2 is set slightly larger than an opening width of the upper die 4. Thus, when the dies are closed, a slight level difference δ is formed at a die-matching surface between the lower die 2 and the upper die 4. Note that the extension 2*a* may have a straight shape or a tapered shape that opens slightly outward, instead of a curved shape.

Figure 5:
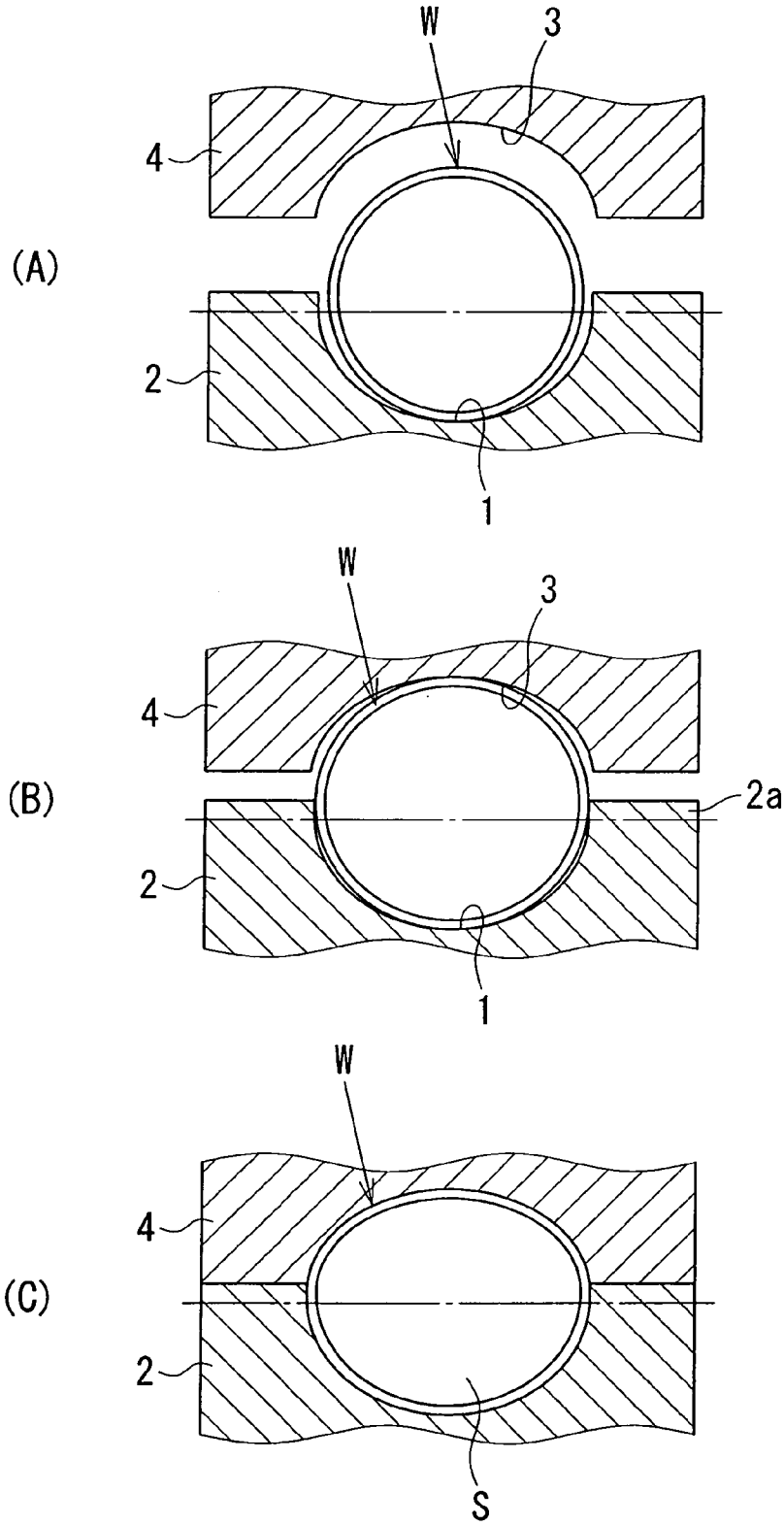
FIG. 5 shows cross-sectional views illustrating step by step correction processes for the metal tube using the press die.

In correction of the bent metal tube W using the press die, the dies are closed while compressing the bent metal tube W in a circumferential direction, as described later (FIG. 5) so that the bent metal tube W is plastically deformed to have a substantially oval cross-section. The forming space S having a substantially oval cross-section formed between the lower die 2 and the upper die 4 is set to an appropriate size, taking into account the compression rate at this time. The compression rate is preferably set to approximately 2 to 3%, based on a balance between a clamping force and a shape freezing property after the correction. In accordance with this compression rate, the size of the forming space S is set. The dimension of the major axis b of the forming space S having a substantially oval cross-section, that is, the opening widths of the forming recesses 1, 3, is designed to be sufficiently longer than an outer diameter of the bent metal tube, taking into account the setting property of the bent metal tube W. However, the longer the dimension of the major axis b, the greater the ellipticity of the forming space S (a/b), due to the compression rate described above. As a result, it becomes difficult to uniformly compress the entire bent metal tube W. Therefore, the dimension of the major axis b is set as large as possible within an appropriate ellipticity range. For example, it is ideal if the ellipticity is approximately 0.8 to 0.85.

Also, the height h of the extension 2*a* of the lower die 2 that is created by deviating the parting line L (the amount of deviation of the parting line) is set to be higher than a portion of the bent metal tube W that first contacts the wall surface of the forming recess during die closure. This is to prevent the wall of the bent metal tube W from bulging into the clearance between the lower die 2 and the upper die 4 and buckling or pinching during compression (during die closure). The height h is set to approximately 4 to 5 mm, for example.

Meanwhile, when the parting line L is deviated in one direction as described above, if the inner wall surface of the extension 2*a* of the lower die 2 is further inward than the inner wall surface of the forming recess 3 of the upper die 4, the wall of the bent metal tube W is likely to buckle inward due to the force applied by the extension 2*a* during compression. In this case, if the forming recesses 1, 3 are formed by simply dividing the forming space S having a substantially oval cross-section into halves in the minor axis direction, a reverse level difference may occur due to a manufacturing or assembly error of the lower die 2 or the upper die 4. The reverse level difference, in which the inner wall surface of the forming recess 3 of the upper die 4 is located further outward than the inner wall surface of the forming recess 1 of the lower die 2, may cause the inward buckling described above. In order to avoid this risk, the opening width of the forming recess 1 of the lower die 2 is set slightly larger than the opening width of the upper die 4 so as to form the slight level difference δ at the die-matching surface between the lower die 2 and the upper die 4, as described above. It was confirmed in a test that even a reverse level difference of approximately 0.2 mm between the lower die 2 and the upper die 4 can cause inward buckling. Therefore, the level difference δ is designed to be an appropriate size that does not cause a reverse level difference, and factors in the manufacturing errors or the like mentioned above. For example, a level difference δ of approximately 0.3 mm is sufficient.

Hereinafter, a method for correcting a bent metal tube using the press die configured as described above will be explained with reference to FIG. 5.

In the correction of the bent metal tube W, the bent metal tube W is set in the forming recess 1 of the lower die 2, with the upper die 4 open, that is, separated from the lower die 2, as shown in FIG. 5A. In this case, the opening width of the forming recess 1 of the lower die 2 is set sufficiently larger than the outer diameter of the bent metal tube W. Therefore, even if the bent metal tube W has spring-back caused by bending, the bent metal tube W can turn within the forming recess 1 so as to maintain a stable position.

Then, when the upper die 4 is lowered by the movement of the press upper ram, the bent metal tube W is compressed between the lower die 2 and the upper die 4 into a shape having an oval cross-section, as shown in FIG. 5B. When the upper die 4 is further lowered, the bent metal tube W is compressed in the circumferential direction. In this case, both sides of the bent metal tube W first contact the inner wall surface of the extension 2*a* of the lower die 2 formed by deviating the parting line L toward the upper die 4 side. Thus, even if compression in the circumferential direction occurs, the wall of the bent metal tube W is prevented from buckling or pinching outward. In addition, because the inner wall of the forming recess 1 of the lower die 2 is located further outward than the inner wall of the forming recess 3 of the upper die 3 (FIG. 2), the wall of the bent metal tube W is also prevented from buckling inward.

The upper die 4 is finally closed with respect to the lower die 2, and the bent metal tube W fits into the forming space S to have an oval cross-section, as shown in FIG. 5C. The shape of the bent metal tube W is then maintained in this state. Thus, the compression in the circumferential direction during this period causes the bent metal tube W to be deformed in a substantially uniform manner. As a result, the spring-back is eliminated (corrected). Meanwhile, during the compression described above, the bent metal tube W tends to extend, but the tube ends are restrained by the walls 5, 6 that are provided at both ends of the lower die 2. Therefore, the extension of the bent metal tube W is controlled, and as a result, preferable end-face precision can be secured. Note that the upper die 4 is thereafter raised by the movement of the press upper ram. However, the inner wall of the extension 2*a* of the lower die 2 has a curved shape with a large curvature and does not form a negative angle in a die opening direction. Therefore, the bent metal tube W is released from the upper die 4 smoothly.

In the above embodiment, the bent metal tube W is subjected to correction. However, a straight tube that has not been bent may be subjected to correction instead. In general, base tubes after manufacturing have poor shape precision, and a straight tube made from such a base tube needs to be corrected. For correction of the straight tube, a press die that has the same cross-sectional profile as shown in FIGS. 1 and 2, but which has a linear forming space between the upper and lower dies, is prepared. The straight tube is plastically deformed by compression in the circumferential direction using the press die, so as to have a substantially oval cross-section. As a result, a metal tube with good shape precision can be obtained.

EXAMPLES

A straight tube made of JIS G3445 with an outer diameter of 65 mm, a wall thickness of 2.3 mm, and an overall length of 600 mm was bent to manufacture the bent metal tube W shown in FIG. 4. This bent metal tube W was corrected using the press die described in the above embodiment (FIGS. 1 to 3). The ellipticity (a/b) of the forming space S having a substantially oval cross-section that is formed when the dies are closed was set to 0.85. The amount of the deviation h of the parting line was set to 4.0 mm, and the level difference δ between the inner wall of the forming recess 1 of the lower die 2 and the inner wall of the forming recess 3 of the upper die 4 was set to 0.3 mm. The bent metal tube W was corrected by compression in the circumferential direction at a compression rate of 2.5%. Then, a bent metal tube W after bending and a bent metal tube W after correction were each fixed to a measuring stand, by a portion extending from 3 to 4 in FIG. 4. Thereafter, the positions (positional accuracy) of four portions (upper, lower, right, and left) in the circumferential direction were measured at eight portions indicated in the drawing. The measurement was carried out for 30 (n=30) bent metal tubes W.

Figure 6:
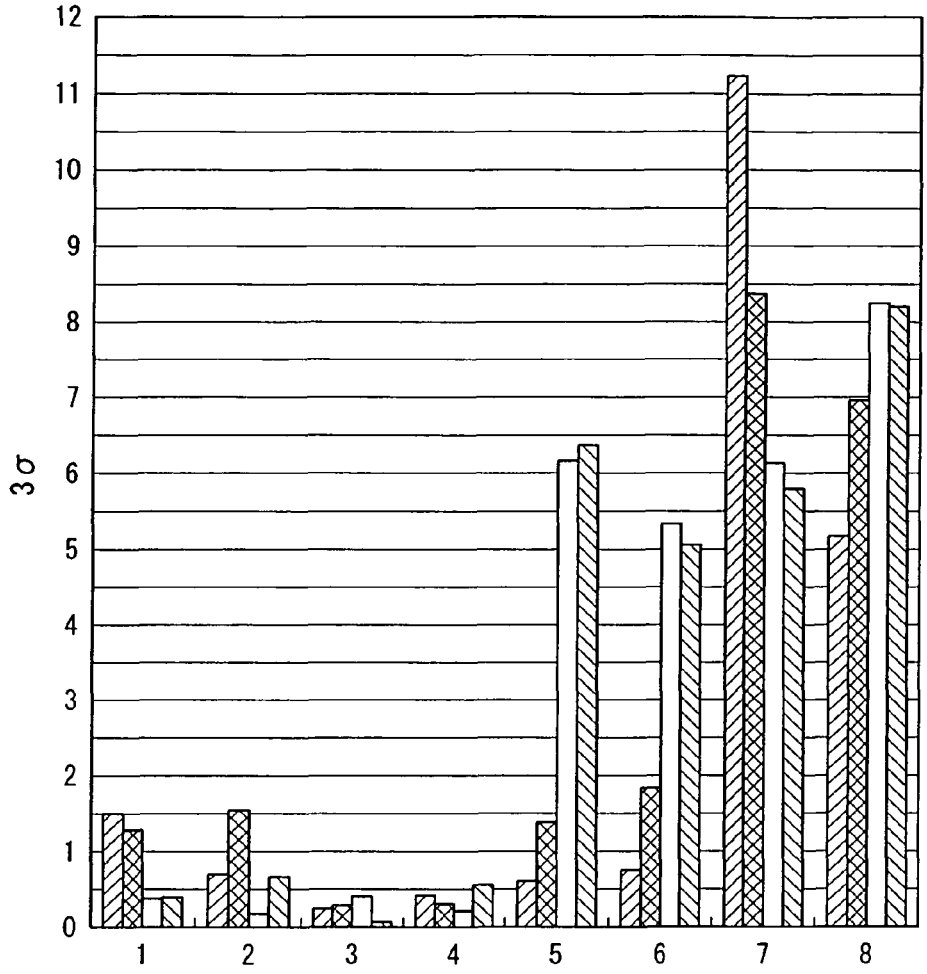
FIG. 6 is a graph showing measurement results of positional accuracy obtained in an embodiment and positional variations of the metal tube after bending.
Figure 7:
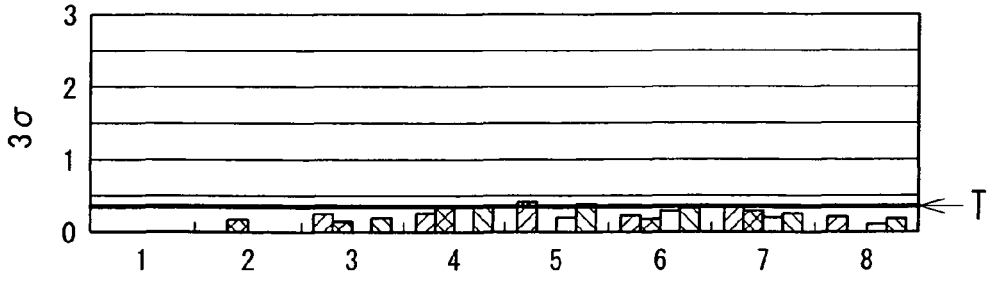
FIG. 7 is a graph showing measurement results of positional accuracy obtained in the embodiment and positional variations of the metal tube after correction.

FIG. 6 shows the measurement results of the bent metal tube after bending, and FIG. 7 shows the measurement results of the bent metal tube after correction. According to these figures, it is clear that the bent metal tubes after bending exhibit significantly large variation in position (3σ) as shown in FIG. 6, and spring-backs of various magnitudes occur in the bent metal tubes. In contrast, the bent metal tubes after correction using the press die show extremely little variation in position as shown in FIG. 7, and it is clear that spring-back was eliminated by the correction. Note that a line T in FIG. 7 is a target deviation, and the bent metal tube after correction sufficiently satisfies this target.

The invention claimed is:

1. A method for correcting a metal tube having a side wall and first and second ends, the method comprising:

preparing a press die, the press die further comprising:

upper and lower dies having forming recesses including semi-oval cross-sectional profiles which form a forming space with a substantially oval cross-section that is wide in a die width direction when the dies are closed;

a parting line between the upper and lower dies that is deviated from a position of a major axis of the forming space toward an upper die side by a predetermined height;

an opening width of the forming recess of the lower die is set larger than an opening width of the upper die forming recess;

walls disposed on at least one of the upper and lower dies that close both ends of the forming space, and wherein the upper and lower dies are curved in their lengthwise directions so as to form bent portions at intermediate parts of the upper and lower dies, closing the press die to compress the side wall of the metal tube with the upper and lower dies and to longitudinally restrain the first and seconds ends of the metal tube with the walls so as to plastically deform the metal tube such that the metal tube has a substantially oval cross-section.

2. The method for correcting a metal tube, according to claim 1 wherein a bent tube that was subjected to bending is used as the metal tube.

3. The method for correcting a metal tube, according to claim 1 wherein a straight tube is used as the metal tube.

4. A press die for correcting a metal tube having a side wall and first and second ends, comprising:

upper and lower dies having forming recesses including semi-oval cross-sectional profiles which form a forming space with a substantially oval cross-section that is wide in a die width direction when the dies are closed;

a parting line between the upper and lower dies that is deviated from a position of a major axis of the forming space toward an upper die side by a predetermined height;

an opening width of the forming recess of the lower die is set larger than an opening width of the upper die forming recess;

walls disposed on at least one of the upper and lower dies that close both ends of the forming space, and wherein the upper and lower dies are curved in their lengthwise directions so as to form bent portions at intermediate parts of the upper and lower dies, wherein when the pressing die is closed, the side wall of the metal tube is compressed with the upper and lower dies and the first and second ends of the metal tube are longitudinally restrained with the walls so as to plastically deform the metal tube such that the metal tube has a substantially oval cross-section.

5. The press die for correcting a metal tube, according to claim 4, wherein an inner wall of a portion formed by deviating the parting line has one of a straight shape, an outward tapered shape, and a curved shape with a large curvature.

* * * * *